United States Patent [19]

Eley

[11] 4,113,339

[45] Sep. 12, 1978

[54] LOAD BREAK BUSHING

[75] Inventor: Edgar R. Eley, Athens, Ga.

[73] Assignee: Westinghouse Electric Corp., Pittsburgh, Pa.

[21] Appl. No.: 828,467

[22] Filed: Aug. 29, 1977

[51] Int. Cl.[2] ..... H01R 13/52

[52] U.S. Cl. ..... 339/111; 200/144 R; 339/143 R; 339/255 R

[58] Field of Search ..... 200/144 R, 144 C, 149 A; 339/111, 12 R, 12 G, 143 R, 143 T, 255 R

[56] References Cited

U.S. PATENT DOCUMENTS

| | | | |
|---|---|---|---|
| 3,539,972 | 11/1970 | Ruete et al. | 339/111 |
| 3,542,986 | 11/1970 | Kotski | 200/149 A |
| 3,930,709 | 1/1976 | Stanger et al. | 200/144 R X |
| 3,945,699 | 3/1976 | Westrom | 339/111 X |
| 3,957,332 | 5/1976 | Lambert | 339/111 X |
| 3,958,855 | 5/1976 | Oakes | 200/144 C X |
| 3,989,341 | 11/1976 | Ball | 339/111 |

*Primary Examiner*—Roy Lake

*Assistant Examiner*—DeWalden W. Jones

*Attorney, Agent, or Firm*—William M. Hanlon, Jr.

[57] ABSTRACT

An electrical load break bushing having a movable tubular conductor therein, engageable with a contact pin of an electrical connector, is arranged to minimize the duration of arc during load-make and load-break operations. A locking member holds the tubular conductor in a first, normally-open position until the contact pin engages the tubular conductor whereon the mated tubular conductor and contact pin assembly move toward a second, normally-closed position. A second contact, adapted to engage the tubular conductor, is supported by the bushing at the second position and is disposed within the dielectric fluid surrounding an electrical apparatus such that an electrical circuit is completed within the dielectric fluid. During a load-break operation, interlock pins prevent the tubular conductor and contact pin from disengaging until the tubular conductor has separated from the second contact whereby the electrical circuit is broken within the dielectric fluid.

11 Claims, 4 Drawing Figures

LOAD BREAK BUSHING

BACKGROUND OF THE INVENTION

1. Field of the Invention:

This invention relates, in general, to electrical connectors and, more specifically, to load-break bushings for use with plug-in type electrical connectors.

2. Description of the Prior Art:

The recent interest in underground distribution power systems for residential areas has resulted in the development of plug-in electrical connectors which enable the high voltage shielded cables of the electrical distribution system to be quickly connected and disconnected from electrical apparatus, such as distribution transformers and electrical switches. Such connectors are, typically, characterized by an elongated male contact pin which is electrically connected to the high voltage cable of the distribution system. A housing surrounds the male contact pin and has an elbow configuration with a "D" hook located at the apex of the elbow. The "D" hook is located in alignment with the longitudinal axis of the male contact in the connector, enabling the operator to grasp the "D" hook with a hot stick tool and forcibly urge the male contact pin of the electrical connector into or out of electrical engagement with a corresponding female contact located, for example, in a transformer mounted bushing.

In the past, load-break bushings have been susceptible to failure since, under certain conditions of loading and with certain transformer connections, the full three phase voltage may appear across the bushing contacts causing damage thereto. For this reason, the electrical industry is in the process of adopting a new standard requiring a so-called "three phase-rated" bushing.

In actual operation, an arc is struck between the male and female contacts during load-make and load-break operations; with the duration of the arc determined by the closure or separation speed utilized by the operator. The relatively slow speed utilized by the operator normally presents no problems since the contacts can be designed to withstand the arc that is drawn between them as they are moved toward engagement or drawn apart. However, if a fault, such as a short circuit, exists on the distribution system, the closure speed becomes increasingly important since the arc energy level increases proportionally to the magnitude of the abnormally high fault current. In addition, the high voltages utilized in such distribution systems result in the arc being drawn over a longer distance. The subsequent longer arcing time and increased arc energy during fault close-in frequently damages the conducting elements of the bushings and presents a substantial danger to the operator. The arc that is drawn during a fault close-in causes a substantial quantity of gas to be generated by the arc quenching material commonly used in these types of connectors thereby creating extremely high pressures within the bushing housing which impedes the closure of the contacts and frequently results in a blow-back of the contacts towards the operator.

It has been proposed to reduce the duration of the arc by closing the contacts at a high rate of speed. A typical method of closing the contacts at a high rate of speed, as shown in U.S. Pat. Nos. 3,542,986; 3,930,709 and 3,958,855, utilizes the arc produced gases to operate a piston in such a manner so as to accelerate contact closure. Another commonly used method, shown in U.S. Pat. Nos. 3,945,699 and 3,957,332, utilizes a magnetic solenoid principle wherein a magnetic means, such as a coil, surrounds a movable contact within the bushing and, in response to the arc current flowing therein, drives the contacts together at a high rate of speed. In addition, U.S. Pat. No. 3,989,341 uses a spring means to move a tubular conductor from an interim position towards a cooperating contact pin to effect a rapid closing operation. The effect of the high closing speed in these types of devices is to reduce the arcing time. The same effect can be achieved with slower moving contacts if the arc length can be reduced.

Thus, if would be desirable to provide a load-break bushing which minimizes arc generation during load-make and load-break operations. Furthermore, it would be desirable to provide a load-break bushing which provides effortless closure of the contacts in instances where a fault condition exists on the distribution system.

SUMMARY OF THE INVENTION

Herein disclosed is a novel load-break bushing which minimizes the length of the arc generated during load-make and load-break operations. A hollow elongated housing is mounted on an electrical apparatus, such as a transformer, with one end thereof disposed within the dielectric fluid filled tank of the transformer. A tubular electrical conductor is disposed within the housing and is adapted for axial movement therein. One end of the tubular conductor is adapted to engage a contact pin of an elbow type electrical connector, commonly used in underground distribution systems. The opposite end of the tubular conductor slidably engages a second contact which is supported on the portion of the housing disposed within the dielectric fluid in the tank of the transformer and is, further, electrically connected to the transformer windings. Suitable lock means hold the tubular conductor in a first, normally-open position within the housing until the contact pin electrically engages the tubular conductor. The lock means comprises a radially movable locking ball carried by the tubular conductor. The locking ball moves outward to engage an inwardly projecting shoulder in the housing and thereby prevents movement of the tubular conductor from the first position. A plunger is disposed within an axial bore within the tubular conductor and is movable in response to the insertion of the contact pin into the tubular conductor. The plunger has a shoulder intermediate its ends which releases the locking ball from the shoulder in the housing when the plunger has been depressed a predetermined distance by the contact pin, at which time the male contact pin securely engages the tubular conductor. Continued insertion of the contact pin into the housing drives the tubular conductor and the contact pin axially through the housing to a second, normally-closed position wherein an electrical connection is made between the tubular conductor and the second contact within the dielectric fluid of the electrical apparatus.

The arc that is struck between the tubular conductor and the second contact as they are advanced towards engagement is minimized since the dielectric strength of the fluid assures that the contacts are in close proximity before the arc is struck thereby substantially reducing the length and duration of the arc and its resulting arc energy. The reduced arc length is especially critical during close-in, where a fault, such as a short circuit, exists on the distribution system. The above described load-break bushing minimizes the length of arc generated, especially during fault close-in, despite the relatively slow contact closure speed attending the manual close-in by an operator due to the dielectric strength of the fluid surrounding the second contact in which the electrical circuit is made and broken.

During a load-break operation, the removal of the elbow connector causes the tubular conductor and contact pin assembly to disengage from the second contact under the dielectric fluid which again minimizes arc generation. In addition, the tubular conductor and contact pin are held in secure engagement until the tubular conductor and contact pin assembly has moved a predetermined distance towards the first position thereby insuring that the breaking of the electrical circuit is achieved under the dielectric fluid within the tank of the electrical apparatus. By minimizing arc generation, the novel load-break bushing described herein substantially reduces the possibility of blow-back of the contacts during close-in on a fault which makes such a load-make operation easier and less dangerous for the operator and, furthermore, greatly extends the life of the conducting elements of the bushing.

BRIEF DESCRIPTION OF THE DRAWINGS

The various features, advantages and other uses of the invention will become more apparent by referring to the following detailed description and drawing in which.

DESCRIPTION OF THE PREFERRED EMBODIMENTS

Figure 1:
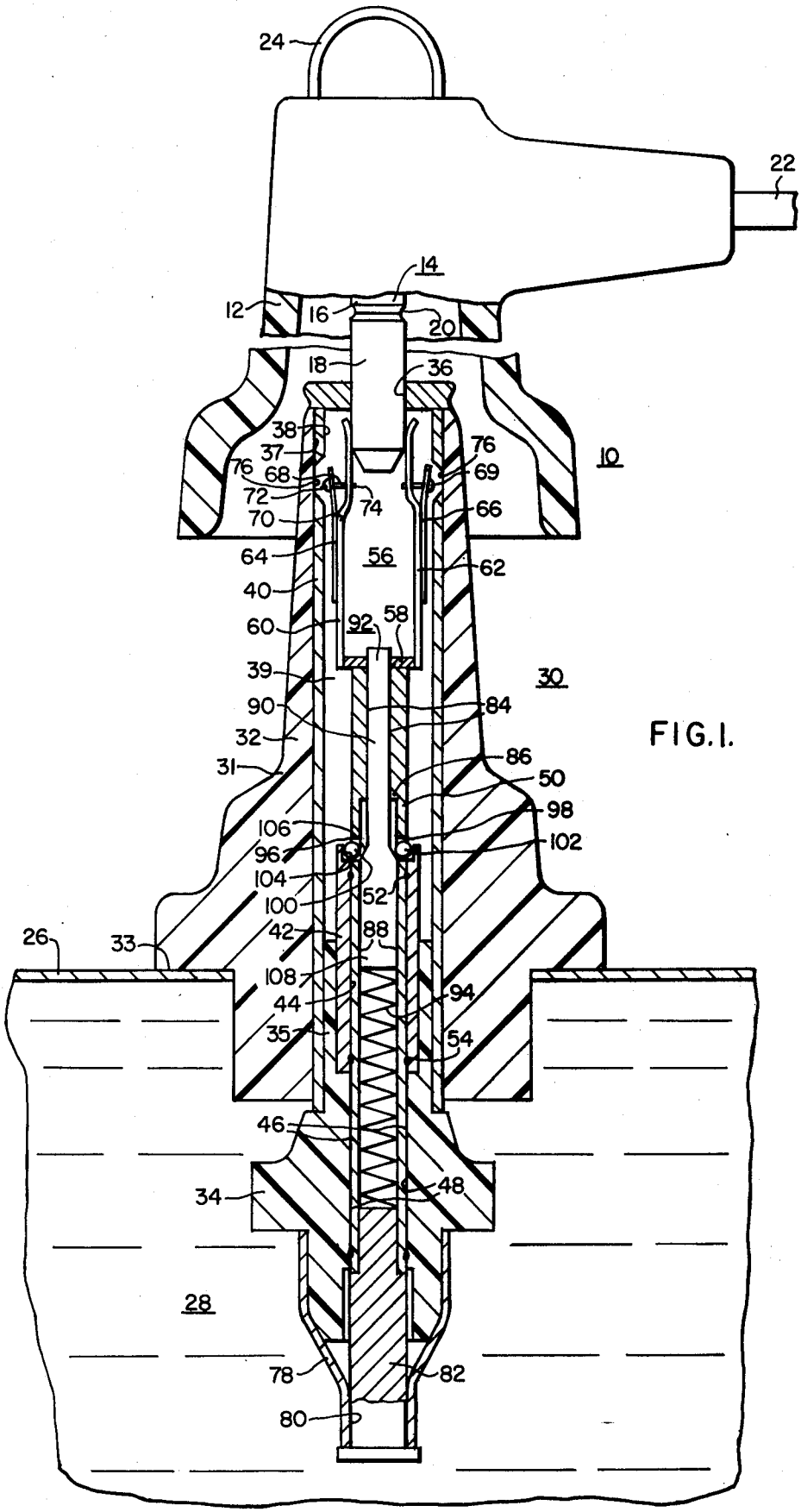
FIG. 1 is a cross-sectional view of a load-break bushing constructed according to the teachings of this invention and of an associated elbow-type connector, shown partially in section and spaced from the bushing to show an open circuit condition.

With reference to the drawing, there is shown in FIG. 1 an elbow-type electrical connector 10 adapted to engage a terminal bushing 30 and thereby electrically connect a distribution system conductor with an electrical apparatus.

Electrical connector 10 is of the conventional elbow-type construction and includes a housing structure 12 constructed of suitable elastomeric material. A contact pin 14 is disposed within the housing 12 and includes an end portion 18 of suitable insulating material and a conducting portion 16 which is connected to an insulated conductor 22 within the housing 12 of the electrical connector 10. A "D" hook 24 is located at the apex of the elbow of the connector 10 and is aligned with the longitudinal axis of the contact pin 14 to enable an operator to grasp the "D" hook 24 with a hot stick tool and forcibly urge the electrical connector 10 into or out of engagement with the terminal bushing 30.

The bushing 30 constitutes an exterior terminal for an electrical inductive apparatus, such as a transformer, (not shown) and, as such, extends through the tank wall 26 of the electrical apparatus. A quantity of dielectric fluid 28 is disposed within the tank of the electrical inductive apparatus and provides electrical insulation and cooling for the transformer situated therein. The bushing 30 includes a hollow elongated housing 31 which consists of an upper portion 32 constructed of a molded elastomeric material and a lower portion 34, constructed of suitable arc-quenching material, such as one sold commercially under the tradename "Delrin". The lower portion 34 of the housing 31 is disposed within the dielectric fluid 28 within the tank of the transformer for reasons that will become apparent hereafter. The upper housing portion 32 also includes a flange portion 33 whereby the bushing 30 is securely mounted to the tank wall 26 of the transformer by suitable means (not shown). The upper housing portion 32 further includes an opening 36 adjacent its upper end wherein the contact pin 14 of the electrical connector 10 is inserted.

An axial bore 37 extends through the upper housing portion 32 wherein there is disposed a longitudinally extending sleeve member 38 which is secured to the inner surface of the axial bore 37. The inner surface of the sleeve member 38 defines in part a longitudinally extending passage 39 within the upper housing portion 32 of the bushing 30. The sleeve 38 is constructed of suitable electrically conductive material, such as copper or aluminum, in order to provide adequate shielding for the conducting elements disposed therein. The lower housing 34 contains an upwardly extending flange portion 35 which is disposed within the passage 39 within the upper housing 32 and, further, is sandwiched between the first longitudinal sleeve member 38 and a second cylindrical sleeve member 42 to form an oil-tight seal which prevents the dielectric fluid 28 within the tank of the transformer from entering the interior passage 39 of the terminal bushing 30. The lower housing 34 also includes an axial bore 46 which is in alignment with the inner surface of the second or locking sleeve member 42 to define a passage 48 wherein there is disposed a tubular electrical conductor 50.

The tubular conductor 50 is slidably mounted within the axial bore 48 and contains O-rings 52 and 54 to prevent the dielectric fluid 28 from entering the interior of the axial passage 48. The tubular conductor 50 further includes a first contact means 56 connected to its upper end 58 which is adapted to engage the contact pin 14 of the electrical connector 10. The first contact means 56 includes first and second contact fingers 60 and 62, respectively, although other suitable electrical connectors may also be utilized. Suitable means, such as interlock assemblies 64 and 66, are provided to hold the contact fingers 60 and 62, respectively, in secure connection with the contact pin 14 of the electrical connector 10 throughout the engagement and disengagement of the electrical connector 10 with the bushing 30. Since the interlock assemblies 64 and 66 are identical, only interlock assembly 64 will be described in detail hereinafter. Accordingly, interlock assembly 64, which is associated with contact finger 60, includes an interlock pin 68 and an interlock spring 70 which provides an outward biasing force on the interlock pin 68. Interlock pin 68, which is affixed to the interlock spring 70, includes a knob portion 72 and a pin portion 74. The pin portion 74 extends through the interlock spring 70 and the first contact finger 60 to engage a notch 20 between the end or probe portion 18 and the conducting portion 16 of the contact pin 14 of the electrical connector 10 to provide a secure electrical engagement between the first contact finger 60 and the contact pin 14 of the electrical connector 10. The first sleeve member 38 includes an inwardly projecting shoulder portion 76 adjacent its upper end. The interlock spring 70 outwardly biases the interlock pin 68 to engage the shoulder portion 76 of the sleeve member 38 when the tubular conductor 50 is in the position shown in FIG. 1 upon the withdrawal of the electrical connector 10 from the bushing 30 thereby releasing the compressive force on the contact pin 14 and the contact finger 60 and enabling contact pin 14 to be withdrawn from the contact fingers 60 and 62. During the movement of the contact pin 14 and tubular conductor 50 through the housing 34, the inner surface of the sleeve 38 compresses the interlock pin 68 against the contact pin 14 and thereby holds the first and second contact fingers 60 and 62 in secure electrical engagement with the contact pin 14.

There is also shown in FIG. 1 a second contact 78 which is supported by the lower bushing housing 34 and is disposed within the dielectric fluid 28 within the tank of the electrical apparatus. The second contact 78 is connected to an electric load, such as the windings of a transformer and, further, is adapted to engage the tubular conductor 50 such that an electric circuit comprising contact pin 14 of the electrical conductor 10, the tubular conductor 50, the second contact 78, and the electrical load is completed or made within the dielectric fluid 28. The second contact 78 also includes an opening 80 in its lower end through which extends a cylindrical follower 82. The follower 82 is journaled in the lower end of the tubular conductor 50 and is constructed of suitable arc-quenching material to provide additional protection for the arc struck between the tubular conductor 50 and the second contact 78 as they are moved towards engagement or drawn apart. In addition, the portion of the second contact 78 that engages the tubular conductor 50 is slotted (not shown) to provide a spring action that insures a solid electrical connection and further, to allow the dielectric fluid 28 to flow into the area around the second contact 78.

In order to insure that the electrical circuit is made or broken within the dielectric fluid 28, suitable lock means are provided which hold the tubular conductor 50 in a first, normally-open position, such as that shown in FIG. 1, until the contact pin 14 of the electrical connector 10 securely engages contact fingers 60 and 62; at which time lock release means release the lock means and allow the tubular conductor 50 and the contact pin 14 to move to a second, normally-closed position in which the tubular conductor 50 engages the second contact 78 and completes the electrical circuit within the dielectric fluid 28. To this end, tubular conductor 50 contains a narrow axial bore 84. A flange 86 intermediate the ends of the tubular conductor 50 opens the axial bore 84 into an enlarged portion 88 wherein there is disposed a movable plunger 90. The plunger 90, which is slidably disposed within the bore 88 of the tubular conductor 50, contains an end portion 92 which extends completely through the axial bore 84 and the first end 58 of the tubular conductor 50 and into the area between the first and second contact fingers 60 and 62. The end portion 92 of the plunger 90 contacts the contact pin 14 of the electrical connector 10 as the connector 10 is inserted into the bushing 30 which causes the plunger 90 to be slidably depressed within the axial bore 88. Suitable biasing means, such as spring 94, is disposed within the axial bore 88 and supported by the follower 82 to provide an upward force on the plunger 90 during the withdrawal of the electrical connector 10 from the bushing 30.

Radially extending bores 96 and 98 are disposed intermediate the ends of the tubular conductor 50 and extend from the enlarged axial bore 88 within the tubular conductor 50 through the outer surface of the tubular conductor 50. Disposed within the radial bores 96 and 98 and carried by the tubular conductor 50 are radially movable locking members, such as locking balls 100 and 102, both of which have a diameter greater than the length of the radial bores 96 and 98, respectively. The second locking sleeve 42 includes an inwardly projecting shoulder portion 104 adjacent its upper end which cooperates with the locking balls 100 and 102 and the plunger 90 to provide a lock means which holds the tubular conductor 50 in the first, normally-open position until the contact pin 14 securely engages the tubular conductor 50. The lock control means for releasing the locking balls 100 and 102 from the shoulder 104 and the locking sleeve 42 consists of the plunger 90 having an inwardly projecting shoulder 106 intermediate its ends which divides the plunger 90 into the narrow end portion 92 and an enlarged portion 108. When the plunger 90 has been depressed by the insertion of the contact pin 14 into the tubular conductor 50 to a position such that the shoulder portion 106 of the plunger 90 is adjacent the locking balls 100 and 102, the locking balls 100 and 102 are free to move radially inward thereby releasing the tubular conductor 50 from the first position and allowing movement of the tubular conductor 50 and the contact pin 14 axially through the bushing 30 towards engagement with the second contact 78.

Figure 2:
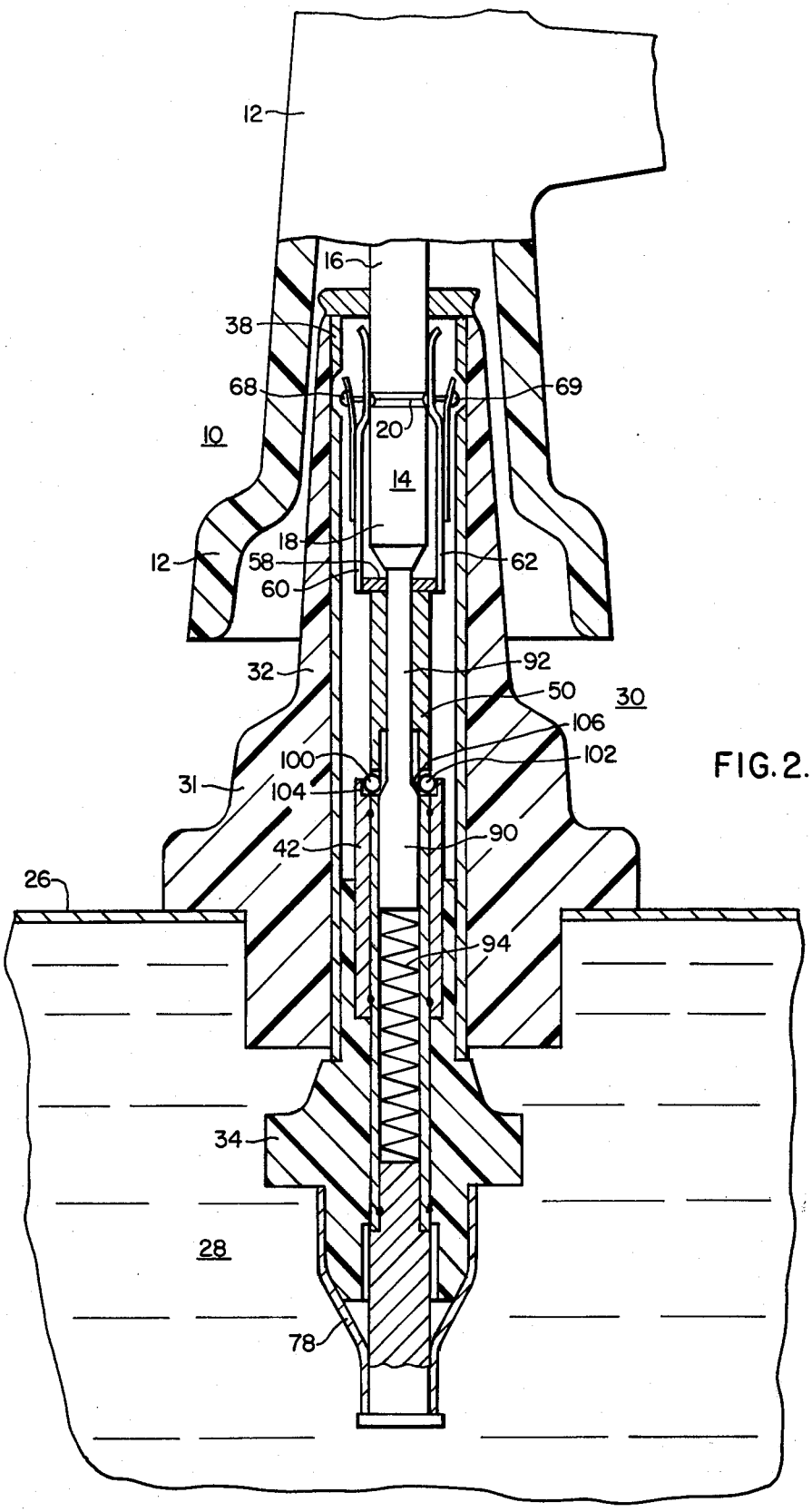
FIG. 2 is a view similar to FIG. 1 but showing the components in the position which they occupy during a load-make operation with the elbow connector partially inserted into the bushing.
Figure 3:
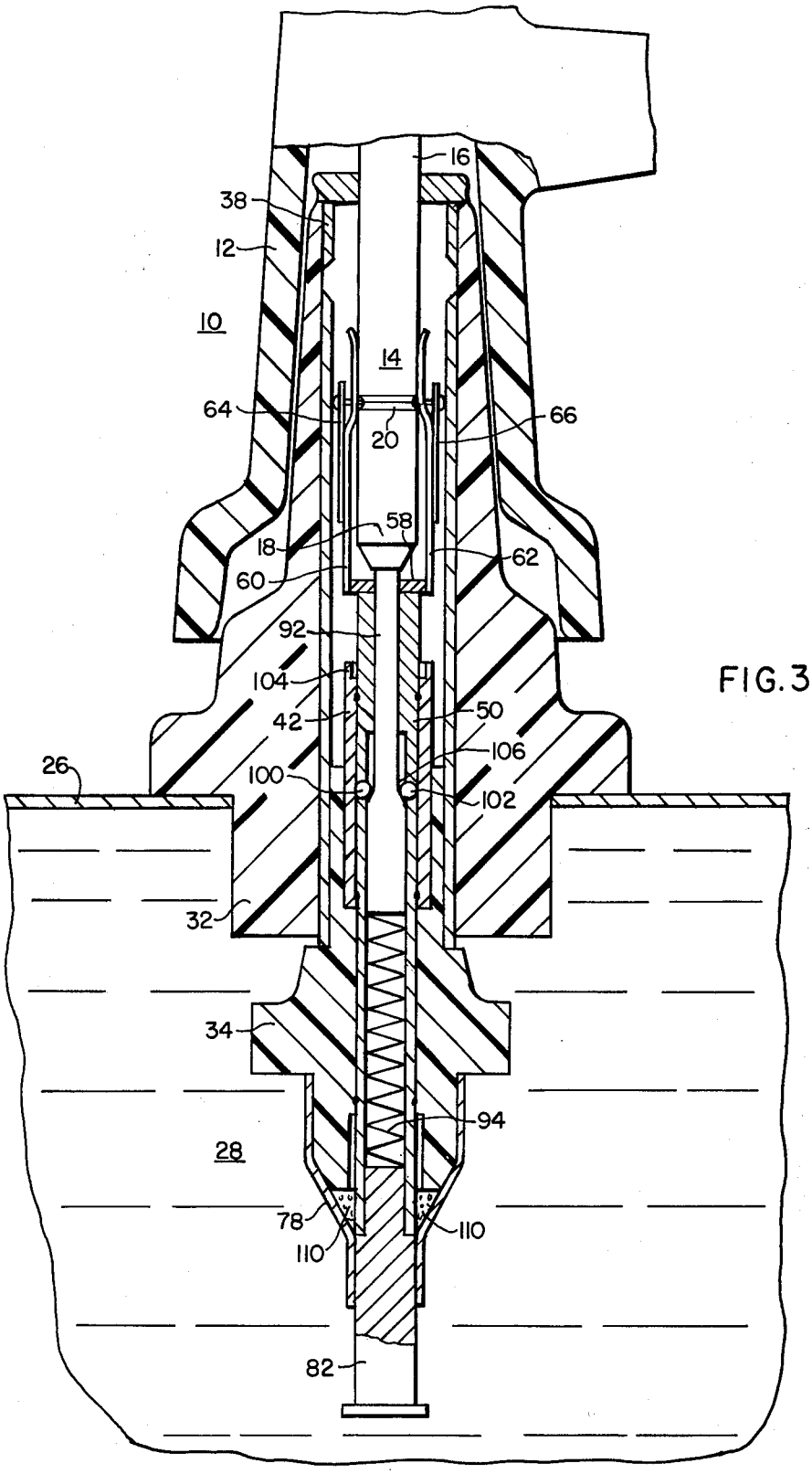
FIG. 3 is a view similar to FIG. 2 but showing the components in the position which they occupy immediately prior to the load-make position; and, FIG. 4 is a view similar to FIG. 3 but showing the components in the load-make position with the elbow connector completely inserted into the bushing.
Figure 4:
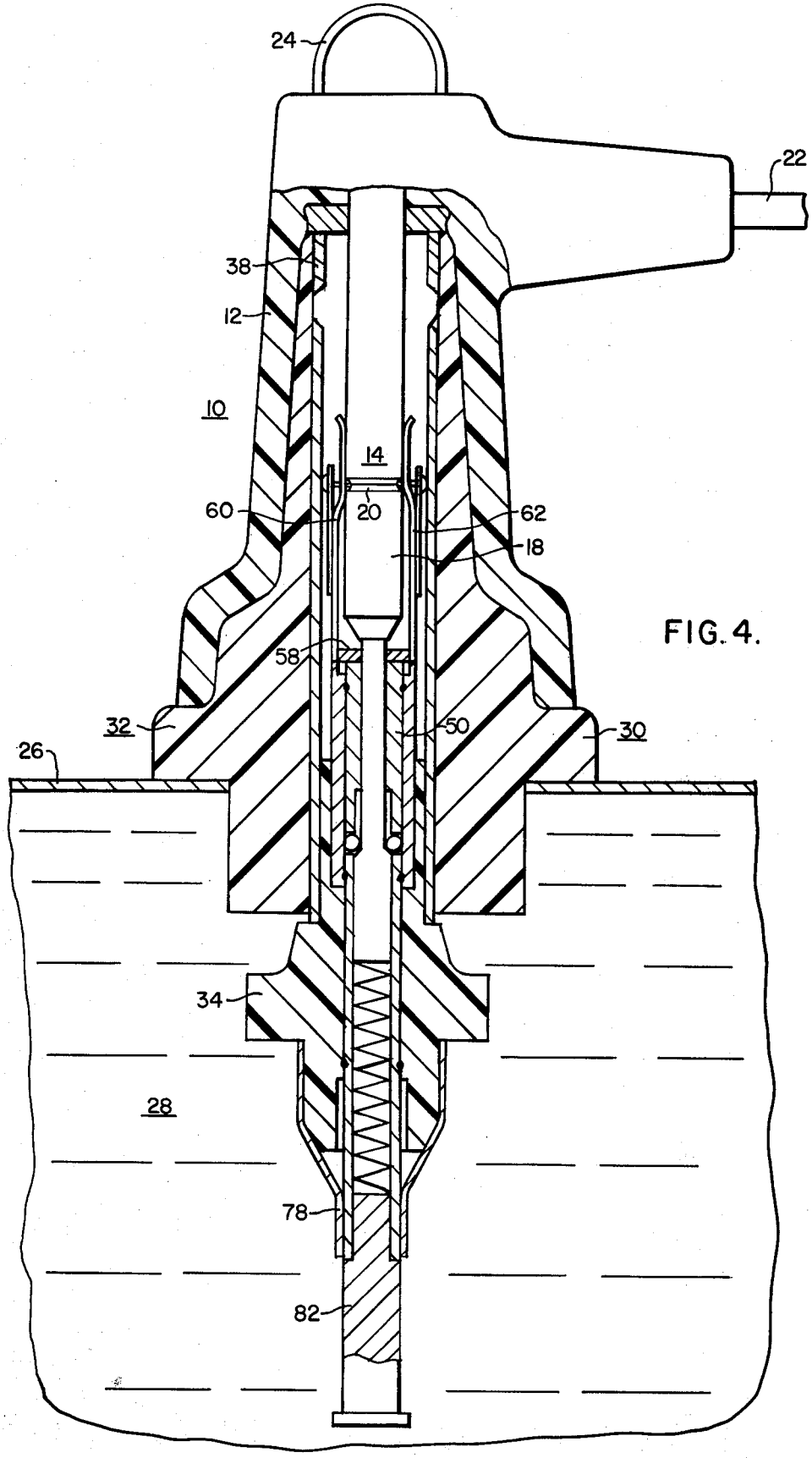

The cooperation of the above-described components will be more clearly understood by reference to FIGS. 2, 3 and 4 and the following description of a typical load-make operation. Prior to the insertion of the electrical connector 10 into the bushing 30, the tubular conductor 50 is disposed in the first, normally-open position shown in FIG. 1 wherein the plunger 90 is upwardly biased by spring 94 such that the end of portion 92 of the plunger 90 is disposed in the area defined by the first and second contact fingers 60 and 62, respectively. FIG. 2 depicts the position of the components with the electrical connector 10 partially engaging the bushing 30 such that the contact pin 14 has depressed the plunger 90 to a position wherein the shoulder 106 in the plunger 90 is adjacent the locking balls 100 and 102. At this time, the locking balls 100 and 102 are released from the shoulder 104 in the locking sleeve 42 and are free to move radially inward to engage the shoulder 106 on the plunger 90 thereby allowing axial movement of the tubular conductor 50 through the bushing 30. At approximately the same time, the interlock pins 68 and 69 engage the notch 20 between the probe end 18 and the conducting end 16 of the contact pin 14 thereby securely engaging the first and second contact fingers 60 and 62 with the contact pin 14 such that continued insertion of the electrical connector 10 and the contact pin 14 contained therein causes an axial movement of the tubular conductor 50 from the first, normally-open position towards the second contact 78 disposed at the second, normally-closed position.

FIG. 3 depicts an interim position of the tubular conductor 50 immediately prior to the completion of the electrical circuit between the tubular conductor 50 and the second contact 78. As is apparent from the drawing, the interlock assemblies 64 and 66 are compressed by the inner surface of the sleeve 38 such that a secure electrical connection is maintained between the first and second contact fingers, 60 and 62, and the conducting portion 16 of the contact pin 14. At this point in the load-make sequence, an arc, generally indicated by reference number 110, will be struck between the tubular conductor 50 and the second contact 78. However, the high dielectric strength of the fluid 28 contained within the tank 26 of the electrical apparatus and surrounding the second contact 78 insures that the tubular conductor 50 and the second contact 78 are in close proximity when the arc 110 is struck thereby minimizing the duration and length of the arc and, also, its energy level. In addition, the arc-quenching material utilized in the construction of the follower member 82 aids in reducing the duration of the arc by producing quantities of gas which help to quench the arc. The operator continues to exert downward force until the interior of the housing 12 of the electrical connector 10 mates with the exterior surface of the upper bushing housing 32, as shown in FIG. 4; at which time the tubular conductor 50 securely engages the second contact 78 thereby completing the load-make operation.

The components interact in a reversed manner during a load-break operation in which operator exerts an upward force on the electrical connector 10 to forcibly disengage the connector 10 from the bushing 30. In response to the upward force, the contact pin 14 and the tubular conductor 50 move axially upward through the bushing 30. When the tubular conductor 50 reaches the position indicated in FIG. 3, an arc will again be struck between the tubular conductor 50 and the second contact 78. However, the dielectric fluid 28 surrounding the second contact 78 will limit the duration and energy level of the arc and thereby protect the conducting elements of the bushing 30 from damage. During the upward movement of the tubular conductor 50 through the bushing 30, the spring 94 will exert an upward force on the bottom of the plunger 90 which will cause the plunger 90 to move in conjunction with the tubular conductor 50. When the tubular conductor 50 reaches the position shown in FIG. 2 during a load-break operation, the locking balls 100 and 102 will be in proximity with the shoulder 104 in the locking sleeve 42. The spring 94 will continue to exert an upward force on the plunger 90 causing the plunger 90 to continue in an upward direction until the enlarged portion 108 of the plunger is adjacent the locking balls 100 and 102. At this time, the locking balls 100 and 102 are driven into engagement with the shoulder 104 in the locking sleeve 42 thereby stopping further movement of the tubular conductor 50. At this time, the interlock pins 68 and 69 will be in proximity with the shoulder 76 in the sleeve 38 which releases the compressive force exerted on the interlock pins 68 and 69 and allows the contact pin 14 to be forcibly urged past the interlock pins 68 and 69 to effect complete disengagement of the electrical connector 10 from the bushing 30.

The above-described load-break bushing may also be utilized with connectors having a fuse assembly therein. This type of load-break connector, such as that shown in greater detail in U.S. Pat. No. 3,892,461, issued to A. Keto and assigned to the assignee of the present application, includes a fuse element which is serially connected between the distribution system conductor and a conductive shaft. The conductive shaft resembles the electrical contact of an elbow-type connector and, as such, the above-described load-break bushing mechanism functions identically regardless of which type of connector is inserted therein. It should be pointed out that, due to the dimensional differences between the two types of connectors, modifications in the design of the bushing housing are necessary in order to accommodate the fused type connector; which changes, however, do not depart from the teachings of this invention.

Thus, it will be apparent to one skilled in the art that there has been disclosed a novel load-break bushing which minimizes the length and duration of an arc generated during load-make and load-break operations between an electrical connector having an electrical potential imposed thereon and the portion of the load-break bushing connected to an electrical load. Initial contact is made between a tubular conductor disposed within the bushing and the male contact pin of an electrical connector in ambient air before the tubular conductor advances through the bushing to electrically engage the second contact disposed within dielectric fluid and connected to an electrical load, such as a transformer. The high dielectric strength of the fluid surrounding the second contact insures that the tubular conductor and the second contact are in close proximity before an arc is struck between them as they are advanced towards engagement or drawn apart. This minimizes the duration of the arc and its associated energy level thereby reducing damage to the conducting elements of the bushing. Further, a relatively slow closure rate of the contacts, such as that employed by an operator in manually engaging the electrical connector and the bushing, may be utilized without detrimental effect, even on fault close-in which previously necessitated a fast closure speed to minimize arc generation. By minimizing arc generation during a fault close-in, the novel load-break bushing depicted herein further provides an effortless load-make capability with less chance of blow-back during close-in on a fault.

What is claimed is:

1. A load-break bushing for a fluid filled electrical apparatus, comprising:

a tank;

an electrical element disposed within said tank;

a quantity of dielectric fluid disposed within said tank;

a hollow elongated housing having an axial passage extending therethrough, said housing having upper and lower portions, said upper portion extending through said tank to the outside thereof, said lower portion extending into said dielectric fluid within said tank;

an electrical conductor, having first and second ends, disposed within said axial passage and adapted for movement therein between a first and second position;

a first electrical contact exteriorly movable relative to said housing;

said first end of said electrical conductor being adapted to engage said first contact;

a second electrical contact attached to said lower portion of said housing such that said second contact is surrounded by said dielectric fluid within said tank, said second contact being adapted to engage said second end of said electrical conductor in said second position and, further, being adapted for connection to said electrical element within said tank;

means for preventing movement of said electrical conductor from said first position until the engagement of said first contact with said first end of said electrical conductor to insure that the electrical circuit between said first contact, said electrical conductor, said second contact and said electrical element is made within said dielectric fluid within said tank; and means for sealing said axial passage in said housing to prevent said dielectric fluid from entering therein such that said dielectric fluid surrounds only said second contact.

2. The load-break bushing of claim 1 wherein the means for preventing movement includes:

lock means for holding the conductor in the first position until the engagement of the first contact with the first end of said electrical conductor; and lock control means, responsive to the movement of said first contact, for controlling said lock means.

3. The load-break bushing of claim 2 wherein the lock means includes:

a radially movable locking member carried by the electrical conductor;

a lock sleeve disposed within the axial passage in the housing and surrounding said electrical conductor, said lock sleeve having an inwardly projecting shoulder adjacent one end thereof, the lock control means cooperating with said lock sleeve to force said locking member radially outward to engage said shoulder in said lock sleeve to prevent movement of said electrical conductor from the first position until the engagement of the first contact with the first end of said electrical conductor whereon said lock control means releases said locking member from said shoulder in said lock sleeve allowing movement of said electrical conductor from said first position.

4. The load-break bushing of claim 3 wherein the lock control means includes:

the electrical conductor having an axial bore extending therethrough;

said electrical conductor having an inwardly projecting shoulder intermediate its ends defining an enlarged portion of said bore;

a plunger slidably disposed within said enlarged portion of said bore, said plunger having an inwardly projecting shoulder intermediate its ends defining a narrow end portion, said end portion extending through said axial bore and the first end of said electrical conductor to engage the first contact such that said plunger is depressed by said first contact when said first contact is moved towards engagement with said first end of said electrical conductor;

said shoulder portion of said plunger releasing the locking member from said shoulder in the lock sleeve when said plunger has been depressed a predetermined amount by said first contact to a position wherein said shoulder in said plunger is adjacent said locking member; and biasing means, disposed within said enlarged portion of said axial bore in said electrical conductor, for urging said plunger to the first position when said first contact is withdrawn from said electrical conductor.

5. The load-break bushing of claim 4 wherein the biasing means is a spring.

6. The load-break bushing of claim 1 further including means for holding the first contact and the electrical conductor in engaged relation until said electrical conductor has traveled a predetermined distance away from the second position such that the electrical circuit is broken within the dielectric fluid.

7. The load-break bushing of claim 6 wherein the holding means includes:

a radially movable latch member;

means for biasing said latch member radially outward;

one end of said biasing means being affixed to the first end of the electrical conductor with said latch member being affixed to the other end of said biasing means; and the housing having an inwardly projecting shoulder adjacent the end of the axial passage in the upper portion of said housing;

said biasing means urging said latch member radially outward to engage said shoulder in said housing when said electrical conductor is in said first position to allow movement of said first contact relative to said first end of said electrical conductor until said electrical conductor has moved from said first position whereon said latch member is retained between said inner surface of said axial passage in said housing and said first end of said electrical conductor thereby applying force to hold said first end of said electrical conductor and said first contact in engagement during movement thereof.

8. The load-break bushing of claim 3 wherein the lock means includes:

the electrical conductor having a radial bore extending from the axial bore therein to the outer surface of said conductor; and the lock member being a locking ball confined within said radial bore by wall surfaces therein and adapted for radial movement therethrough, said locking ball having a diameter greater than the length of said radial bore.

9. A method for closing an electrical circuit between an electrical bushing connected to an electrical inductive apparatus disposed in a fluid filled tank and an electrical contact connected to a source of electrical potential comprising the steps of:

moving said electrical contact into engagement with an electrical conductor slidably disposed within said bushing;

holding said electrical conductor in a first position until the engagement of said electrical contact with said electrical conductor;

releasing said electrical conductor from said first position;

advancing the mated electrical conductor and electrical contact towards a second contact attached to said bushing and disposed within said dielectric fluid within said tank and further, connected to said electrical inductive apparatus; and engaging said electrical conductor and said second contact to close said electrical circuit within said dielectric fluid within said tank.

10. The method of claim 9 further including the step of locking the electrical conductor and the electrical contact together during movement through the bushing.

11. A method for opening an electrical circuit formed between an electrical contact connected to a source of electrical potential and engaged with an electrical bushing connected to an electrical inductive apparatus disposed within a fluid filled tank comprising the steps of:

disengaging an electrical conductor slidably disposed within said bushing and having said electrical contact engaged therewith from a second electrical contact affixed to said bushing and connected to said electrical inductive apparatus and surrounded by said dielectric fluid within said tank such that said electrical circuit is opened within said dielectric fluid;

urging said electrical conductor, having said electrical contact engaged therewith, towards a first position in said bushing;

holding said electrical conductor and said electrical contact in engagement during movement thereof;

locking said electrical conductor in said first position; and releasing said electrical contact from said electrical conductor such that said electrical contact may be completely disengaged from said electrical conductor.

* * * * *